US008747260B1

(12) United States Patent
Glynn

(10) Patent No.: US 8,747,260 B1
(45) Date of Patent: Jun. 10, 2014

(54) BASEBALL TRAINING APPARATUS AND METHOD

(71) Applicant: Eugene P. Glynn, Waseca, MN (US)

(72) Inventor: Eugene P. Glynn, Waseca, MN (US)

( * ) Notice: Subject to any disclaimer, the term of this patent is extended or adjusted under 35 U.S.C. 154(b) by 0 days.

(21) Appl. No.: 13/970,591

(22) Filed: Aug. 19, 2013

Related U.S. Application Data

(63) Continuation of application No. 13/024,257, filed on Feb. 9, 2011, now Pat. No. 8,512,172.

(51) Int. Cl.
*A63B 69/00* (2006.01)

(52) U.S. Cl.
USPC ..... 473/458; 473/422; 473/450

(58) Field of Classification Search
USPC ..... 473/422, 450, 458, 464, 59, 208, 210; 434/247, 252; 2/12
See application file for complete search history.

(56) References Cited

U.S. PATENT DOCUMENTS 1,566,481 A * 12/1925 Keyms ..... 2/12
1,628,551 A * 5/1927 Noyes ..... 2/12
1,712,285 A * 5/1929 Westgaard et al. ..... 2/12
1,936,304 A * 11/1933 Kimbler ..... 2/12
2,788,523 A * 4/1957 Seguin ..... 2/12
3,031,674 A * 5/1962 Ring ..... 2/441
3,228,696 A * 1/1966 Hull ..... 473/210
3,313,031 A * 4/1967 Lowe ..... 33/507
3,436,151 A * 4/1969 Conrose, Sr. ..... 356/72
3,437,339 A * 4/1969 Starck ..... 473/210
3,538,509 A * 11/1970 Sachse ..... 2/12
3,613,116 A * 10/1971 Stroup ..... 473/450
3,660,852 A * 5/1972 Schulenberg ..... 2/12
3,751,818 A * 8/1973 Eller, Jr. ..... 33/375
3,874,672 A * 4/1975 Zank ..... 473/210
4,464,797 A * 8/1984 Glassman ..... 2/209.13
4,696,111 A * 9/1987 Gardner ..... 473/210
5,050,982 A * 9/1991 Meissner ..... 351/203
5,253,870 A * 10/1993 Bedney ..... 473/210
D359,334 S * 6/1995 Taylor ..... D21/791
5,452,027 A * 9/1995 Tylec ..... 351/46
5,879,239 A * 3/1999 Macroglou ..... 473/210
5,929,965 A * 7/1999 Berke ..... 351/50
6,378,390 B2 * 4/2002 Saito ..... 74/159

* cited by examiner

*Primary Examiner* — Mitra Aryanpour
(74) *Attorney, Agent, or Firm* — Albert W. Watkins

(57) ABSTRACT

A baseball training apparatus occludes peripheral vision of each eye across the nose region of a baseball player by creating a visual divide that extends from and immediately adjacent to the nose along the central sagittal plane. In various embodiments, the visual divide is extendible, removable and replaceable, pivotal, and may incorporate scribes to vary shape or geometry. The visual divide may further be mounted from a pair of glasses without lenses, though other embodiments with and without lenses are contemplated. The eye divider is used to align or confirm alignment of a baseball player properly with the pitcher, to ensure that the batter has both eyes facing the pitcher.

5 Claims, 5 Drawing Sheets

BASEBALL TRAINING APPARATUS AND METHOD

CROSS REFERENCE TO RELATED APPLICATIONS

The present application is a continuation of U.S. application Ser. No. 13/024,257 filed Feb. 9, 2011 and scheduled to be granted on Aug. 20, 2013 as U.S. Pat. No. 8,512,172, the contents which are incorporated herein by reference in entirety.

BACKGROUND OF THE INVENTION

1. Field of the Invention

This invention pertains generally to games using tangible projectiles, and more particularly to a player worn baseball training apparatus and associated methods.

2. Description of the Related Art

In the sport of baseball, a player's first or early lesson will be to stand sideways to a pitcher, with shoulders generally lined up to the pitcher. This stance is foreign to many first-time participants, and instead many of those participants will naturally try to face the pitcher. While facing the pitcher inhibits proper swinging motion, and so is frowned upon, a player will preferably face their head to the pitcher. By doing so, the player will gain full benefit of binocular vision, and will best read and respond to changes in pitch and ball flight. Unfortunately, for most beginning players, facing their head to the pitcher while turning their shoulders askance is very unnatural. As a result, proper posture is hard to teach. Additionally, over time even the most skilled players may unintentionally and unknowingly alter their stance. In many cases, the dominant eye of a batter is their back eye. A right handed person who bats right handed will also typically be right eye dominant, and their right eye will be the back eye. If they do not face the pitcher, not only will they lose the benefit of binocular vision, they will be tracking the pitcher and pitched ball with their weaker eye. Unfortunately, there is no apparatus or method available for such players to better facilitate their learning, improvement, or verification of proper stance.

There have been a number of blinders, eye shields, or training devices developed for other sports such as golf, bowling and tennis which are intended to facilitate training and concentration. Exemplary patents and published applications, the teachings and contents which are incorporated herein by reference, include U.S. Pat. No. 2,433,590 by Barr, entitled "Golfer's eyeshield"; U.S. Pat. No. 2,825,065 by Spiezio, entitled "Blinker-equipped spectacles for bowlers"; U.S. Pat. No. 3,868,108 by Kirchner, entitled "Athletic training device"; U.S. Pat. No. 4,168,111 by Baines, entitled "Golfing glasses"; U.S. Pat. No. 4,969,649 by Lugiewicz, entitled "Performance enhancement apparatus"; U.S. Pat. No. 5,050,982 by Meissner, entitled "Method and apparatus for improving visual acuity"; U.S. Pat. No. 5,171,152 by McCleery, entitled "Training device for batters and golfers"; U.S. Pat. No. 5,177,510 by Peters et al, entitled "Alignment eyeglasses"; U.S. Pat. No. 5,661,534 by Gill, entitled "Peripheral vision limiting visor"; U.S. Pat. No. 5,800,278 by Varriano, entitled "Apparatus for signaling proper alignment of user's eye and object to be struck"; U.S. Pat. No. 7,322,693 by Abraham, entitled "Focus-enhancing blinders"; Des 359,977 by Taber et al, entitled "Eye shields for bowling"; WO9100541 by Peters et al, entitled "Alignment eyeglasses"; and WO9850118 by Varriano, entitled "Sports training apparatus".

Additionally, there are inventions developed for driving that prevent glare and distraction, illustrated by the following US patents, the contents and teachings which are incorporated herein by reference: U.S. Pat. No. 1,505,882 by Geiger, entitled "Driving glasses"; U.S. Pat. No. 1,577,700 by Edwards, entitled "Vision deflector"; U.S. Pat. No. 1,653,139 by Westgaard et al, entitled "Eyeshade for auto drivers"; U.S. Pat. No. 1,660,993 by Gales, entitled "Eye protector for vehicle drivers"; U.S. Pat. No. 1,685,725 by Rowe, entitled "Spectacles"; U.S. Pat. No. 1,801,406 by Woodmansee, entitled "Antiglare goggles"; U.S. Pat. No. 1,844,232 by Tharp, entitled "Glare shield for personal wear"; U.S. Pat. No. 1,907,356 by Klein, entitled "Antiglare shield"; U.S. Pat. No. 1,953,320 by Thomas, entitled "Eye protector"; U.S. Pat. No. 2,870,446 by Mitchell, entitled "Pilot's instrument flying hood"; U.S. Pat. No. 3,226,729 by Fucci, entitled "Eye shield"; and U.S. Pat. No. 5,877,837 by Hayes, entitled "Side view mirror glare reduction device".

Light shades, serving more generic purpose, the contents and teachings which are incorporated herein by reference, include: U.S. Pat. No. 673,786 by Ricketts, entitled "Shaded eyeglasses"; U.S. Pat. No. 1,471,967 by Mahlmann, entitled "Eye shade"; U.S. Pat. No. 1,574,144 by White, entitled "Eye shade"; U.S. Pat. No. 1,585,023 by Fant, entitled "Antiglare eye protector"; U.S. Pat. No. 2,176,006 by Ehrlich, entitled "Eyeshield"; U.S. Pat. No. 2,224,560 by Wentz, entitled "Eyeshade means"; and U.S. Pat. No. 2,541,242 by Grove, entitled "Eyeshield".

Sun shield nose protectors, the contents and teachings which are incorporated herein by reference, include: U.S. Pat. No. 1,048,191 by Maurice, entitled "Sun shield for the nose"; U.S. Pat. No. 2,197,973 by Everett et al, entitled "Nose protector"; and U.S. Pat. No. 5,666,664 by Hamilton, entitled "Face protector shade". Some other patents, the contents and teachings which are incorporated herein by reference, include: U.S. Pat. No. 1,252,126 by Letzeisen, entitled "Spectacles", which describes collapsible glasses; U.S. Pat. No. 3,421,233 by Gaal, entitled "Vision training device and method for achieving parallel sightings", which describes a reading training device; and U.S. Pat. No. 5,647,835 by Martineau, entitled "Method for preventing motion sickness", which describes an apparatus to prevent motion sickness.

These aforementioned patents provide a wide variety of glasses and the like which solve a number of diverse problems. Unfortunately, none serve to adequately address the needs of a baseball player trying to determine or optimally adjust his viewing position.

In addition to the foregoing patents, Webster's New Universal Unabridged Dictionary, Second Edition copyright 1983, is incorporated herein by reference in entirety for the definitions of words and terms used herein.

SUMMARY OF THE INVENTION

In a first manifestation, the invention is a baseball training apparatus for assisting a baseball player in keeping their head aligned with an object. A body support couples the baseball training apparatus to a baseball player. An eye divider defines a central sagittal plane of the baseball player, and extends from immediately adjacent to the baseball player's nose to distal therefrom by a distance that is manually adjustable by the baseball player throughout a range of distance manual adjustment. The eye divider divides the baseball player's eyes, remaining immediately adjacent to the baseball player's nose and remaining within the central sagittal plane substantially throughout the range of distance manual adjustment.

In a second manifestation, the invention is a baseball visual training apparatus for confirming proper visual batting alignment. A body support couples the baseball training apparatus to a baseball player. An eye divider defines a central sagittal plane of the baseball player and extends from immediately adjacent to the baseball player's nose to distal therefrom by a distance. A coupling between eye divider and body support permits the eye divider to pivot about an axis normal to the central sagittal plane while remaining within the central sagittal plane.

In a third manifestation, the invention is a method of confirming visual alignment of a baseball player during batting so that both right and left eyes of said baseball player are facing in sight of a pitcher. The steps of the method include extending a visual divide between right and left eyes first defined by a nose on the player's face away from the nose; and retaining the visual divide extension adjacent to the nose and generally within a central sagittal plane of the baseball player.

OBJECTS OF THE INVENTION

Exemplary embodiments of the present invention solve inadequacies of the prior art by providing an eye divider similar to the nose, but extending therefrom. In the preferred embodiment, the eye divider is pivotally mounted from a pair of glasses without lenses, though other embodiments with and without lenses are contemplated. The eye divider is used to align or confirm alignment of a baseball player properly with the pitcher, to ensure that the batter has both eyes facing the pitcher.

A first object of the invention is to provide an apparatus and method for enhancing baseball training. A second object of the invention is to enable the apparatus to be adjustable to players of very diverse sizes and characteristics. Another object of the present invention is to provide an apparatus that is safe to use, and, preferably, durable enough to be transported about in a duffle bag or the like. A further object of the invention is to provide an apparatus and method that are intuitive to players of all skill levels and experience, and which will help them to align with the pitcher. Yet another object of the present invention is to provide an apparatus that may be easily fabricated for low cost.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Manifested in the preferred embodiment, the present invention provides an eye divider 20 similar to a player's nose 4, but extending therefrom. In the preferred embodiment, eye divider 20 is generally planar, has a large surface area relative to thickness, and extends generally along or parallel to the sagittal anatomical plane to divide the player's face into right and left halves. Eye divider 20 is pivotally mounted from a frame resembling a pair of glasses without lenses, though other embodiments are contemplated. The eye divider 20 is used to align or confirm alignment of a baseball player 1 properly with the pitcher, to ensure that the player 1 has both eyes 2, 3 facing directly at the pitcher.

Figure 1:
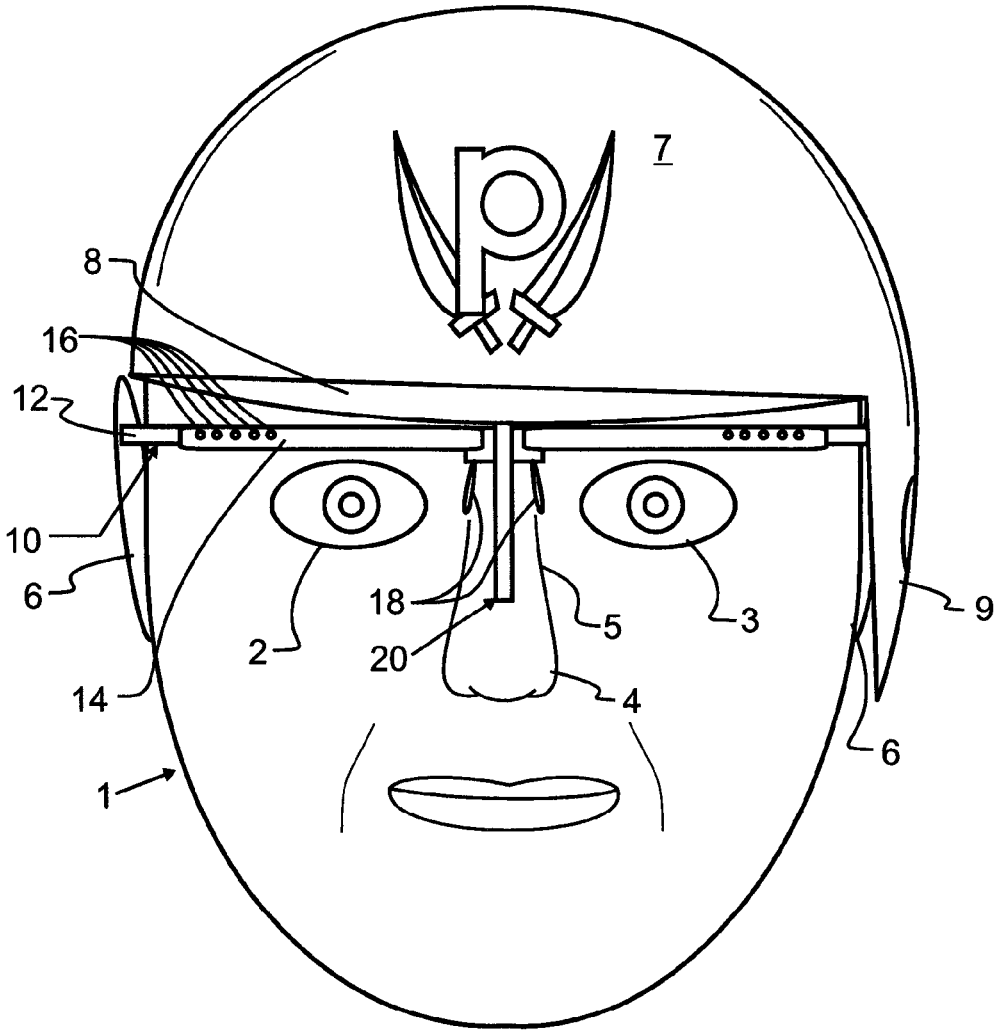
FIG. 1 illustrates a first preferred embodiment baseball training apparatus designed in accord with the teachings of the present invention from a front elevation view.

As illustrated in FIG. 1, an exemplary prior art baseball player 1 has vision from right eye 2 and left eye 3. Player 1 has a nose 4 that extends to the bridge region 5 between right eye 2 and left eye 3. One or both of left and right ears 6 may be covered by a protective extension 9 extending from protective baseball helmet 7. Helmet 7 will also typically include a visor 8 that provides shade from the sun. Prior art player 1 is additionally wearing a first preferred embodiment baseball training apparatus 10 designed in accord with the teachings of the present invention, including a pair of temples or legs 12, left and right frame top bar members 14, and eye divider 20. To couple temples 12 with top bar members 14, at least one protrusion will optionally be provided that extends from each temple 12 and engages within ones of the plurality of holes 16 formed through top bar members 14.

By providing a plurality of holes 16, and preferably two protrusions extending from each temple 12, temples 12 may be press-fit to top bar members 14 at one of several different positions, allowing temples 12 to be moved closer together or spaced farther from each other. This adjustability allows the baseball training apparatus 10 to be set for different users without having to measure and custom fabricate a baseball training apparatus 10 for each baseball player 1. Alternatively, temples 12 may be coupled through standard hinges to top bar members 14 as is taught in the art of eyeglasses and incorporated by reference herein above, or may have other detachable or permanent connection therebetween.

In either the case of adjustable or fixed coupling between temples 12 and top bar members 14, temples 12 may further be fabricated from a resilient material, and be provided with sufficient curvature that the ends of temples 12 distal to top bar members 14 are closer to each other than the ends adjacent. This combination of the free ends of temples 12 being closer together and providing resilience in temples 12 allows the temples to gently squeeze or hold on a person's head. Good materials selection and design may eliminate the need for adjustable connection through holes 16. In such case, it is further contemplated that the preferred baseball training apparatus 10 might, for exemplary purposes only and not limiting the present invention thereto, be provided in only a few sizes, such as a child's size and an adult size, where differences of wearers within the size ranges are fully accommodated by the resilience of temples 12.

Nose piece 18 is preferably designed to rest on nose bridge region 5, and together with temples 12 support the balance of baseball training apparatus 10 upon baseball player 1, preferably in a position as generally illustrated in FIG. 1. Nose piece 18 may take on any of the many geometries known in the glasses art, and the present invention is not limited by one or another design.

Figure 2:
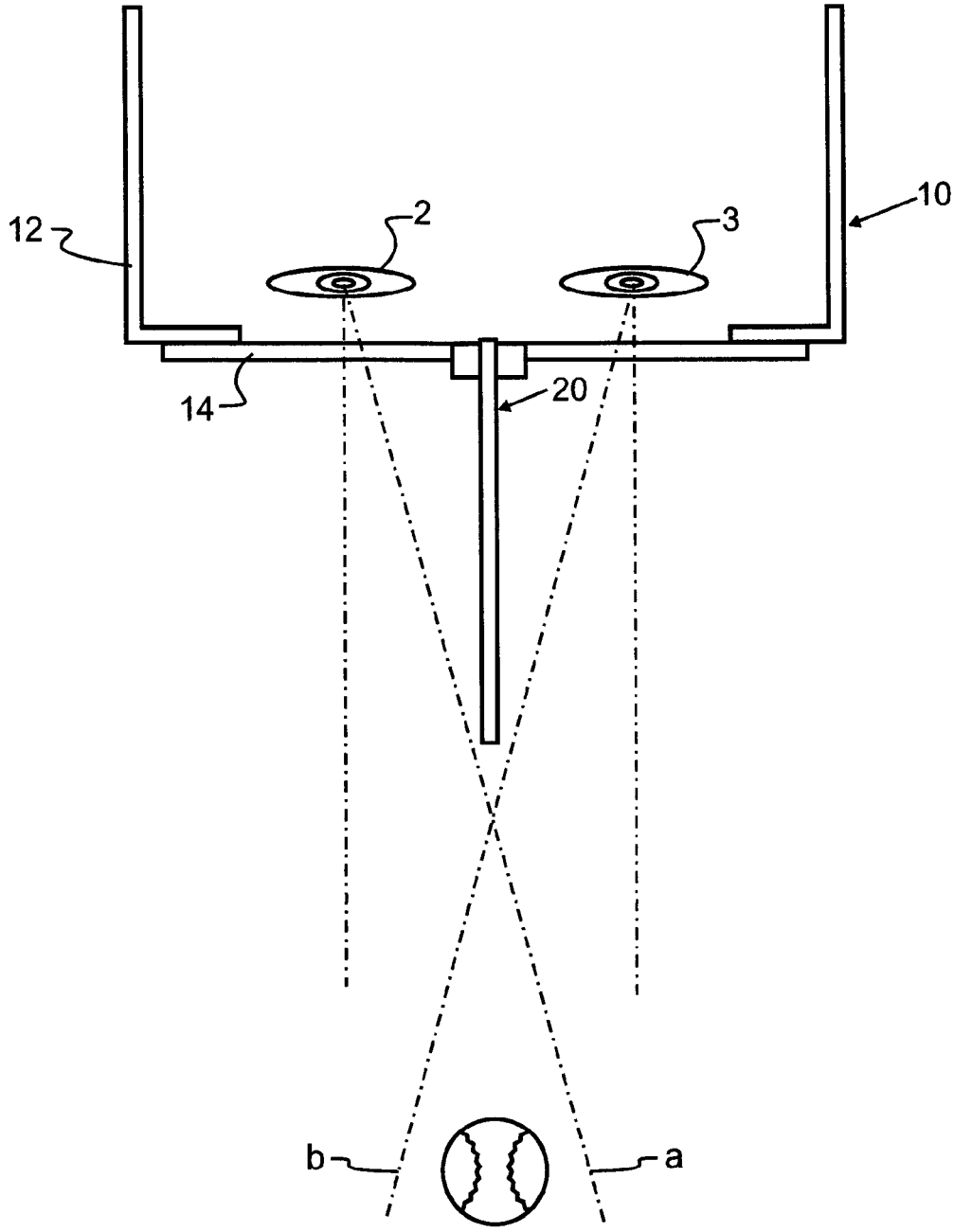
FIG. 2 illustrates the first preferred embodiment baseball training apparatus of FIG. 1 from a top, simplified or schematic view.

FIG. 2 illustrates baseball training apparatus 10 from above, using a very simplified or schematic view to illustrate the operation thereof. A baseball player 1 will most desirably position so that right eye 2 and left eye 3 are facing directly at a pitcher or incoming baseball. To enable baseball player 1 to confirm that eyes 2, 3 are, in fact, directly facing the pitcher, baseball training apparatus 10 is placed on the player's face as shown in FIG. 1. If right eye 2 in FIG. 2 were to be closer to the pitcher or incoming baseball than left eye 3, then the farthest right line of sight from left eye 3, designated by line b in the figure, would become blocked by eye divider 20, such that the baseball or pitcher would no longer be visible through left eye 3. Similarly, if player 1 has his head shifted the other direction, then the baseball or pitcher would no longer be visible through right eye 2 along leftmost line of sight a.

Alternative training methods are contemplated herein that are facilitated by baseball training apparatus 10. According to a first method, eye divider 20 may extend away from the player's nose 4 by a relatively small amount. In this case, eye divider 20 would not fully block the view of the pitcher. Instead, player 1 will try to balance the view of eye divider 20, while keeping the pitcher or ball centered. In this position, eye divider 20 will appear to be both to the left of and to the right of the ball or pitcher. This signifies to player 1 that his head is pointed in the desired direction. If not, then player 1 will need to rotate his head to center the ball or pitcher between the two perceived eye dividers. Noteworthy here is that if eye divider 20 is sufficiently small, the image of the divider may actually seem to disappear, just as a person's nose is usually not noticed during ordinary activities. While for most persons their nose is, in fact, visible, the image is sufficiently unobtrusive to go unnoticed when they are looking directly at an object.

According to a second method, eye divider 20 extends farther from nose 4, and player 1 will simply ensure that the ball or pitcher is visible from both right eye 2 and left eye 3. While this may seem to be the simpler or more preferred method, it is actually not. The larger size of eye divider 20 may result in eye divider 20 becoming too obtrusive and interfering with play. Depending upon materials used, eye divider 20 may also be more readily damaged, either when in use or during transit. Surprisingly, a relatively small eye divider 20 in conjunction with the first method will work well for most players.

According to a third method, baseball training apparatus 10, regardless of the length eye divider 20 extends away from the nose, is only placed upon player 1 briefly, so that player 1 can check for proper stance and posture prior to actually batting. Once stance and posture are confirmed, then player 1 will remove baseball training apparatus 10 for actual batting. This third method is compatible with both the first and second methods of training, and so may be used therewith as desired.

Not all players will have the same nose geometry, yet, preferably, eye divider 20 will be placed or positioned immediately adjacent to nose 4. A gap therebetween can allow a batter to see with the back eye between eye divider 20 and nose 4, thereby rendering eye divider 20 ineffective or less beneficial. For the purposes of the present disclosure, eye divider 20 will be understood to be immediately adjacent to nose 4 when any gap therebetween is sufficiently small to substantially prevent clear or unobstructed vision therebetween.

One variable that can impact this gap, and so is preferably addressed, is the slope of the top-facing surface of the nose. As may be understood, at nose piece 18, the distance between eye divider 20 and nose 4 can be precisely controlled. However, slope of nose 4 will affect the distance therebetween undesirably, if eye divider 20 and nose 4 do not share a common slope. To accommodate the varying geometries of noses, eye divider 20 is preferably mounted to top bar members 14 through a pivoting coupling 30 visible in FIG. 3. This figure also illustrates eye divider 20 in a clockwise extreme rotation relative to temples 12. FIG. 4 illustrates eye divider 20 in a counterclockwise extreme rotation relative to temples 12.

Figure 5:
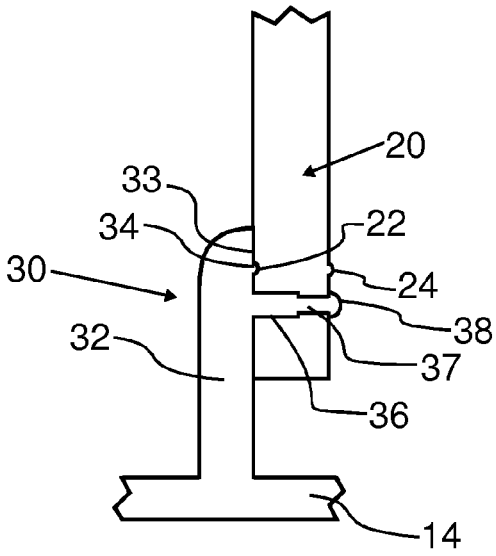
FIG. 5 illustrates an exemplary coupling between eye divider and frame from a sectional view.

FIG. 5 illustrates pivoting coupling 30 through a cross-sectional view, showing an exemplary coupling between eye divider and top bars 14. Coupling body 32 is fixed in position relative to top bars 14, and includes a generally planar, washer-shaped bearing surface 33. Protruding out of the center of bearing surface 33 is bushing 36, retention neck 37, and head 38. The combination of bearing surface 33, bushing 36, retention neck 37, and head 38 securely capture eye divider 20, such that eye divider 20 may simply be pressed over head 38, where it will be captured and be pivotal. Eye divider 20 will rotate about an axis of rotation that is parallel to the longitudinal direction of neck 37, the axis of rotation which is also normal to bearing surface 33.

Eye divider 20 will also most preferably not rotate freely, but will instead incorporate some form of resistance with bearing surface 33, bushing 36, retention neck 37, and head 38 which impedes rotation except when player 1 intentionally manipulates eye divider 20. This may be accomplished a number of ways. For exemplary purposes only, and not limiting thereto, one or more small, discrete hemispherical bumps 34 may be provided that protrude slightly from the surface of bearing surface 33. In this exemplary manifestation, one or more matching hemispherical indentations 22 are provided in eye divider 20. As eye divider 20 is rotated, bumps 34 will fall into indentations 22, which will tend to discourage further rotation of eye divider 20. Only when sufficient force is generated to pull bumps 34 out of indentations 22 will eye divider 20 be rotated further. If eye divider 20 is made from a semi-rigid or rigid sheet material, then indentations 22 may be formed by punching eye divider 20 at appropriate lactations, which will in turn form small bumps 24 on the opposite face of eye divider 20.

While detents formed by bumps 34 and indentations 22 illustrate one method of preventing unintended or unwanted rotation of eye divider 20, many other techniques are contemplated and considered incorporated herein. For exemplary purposes only, and again not limiting the present invention solely thereto, geometries and materials that form friction between pivoting coupling 30 and eye divider 20 may also be used to gain equivalent result. For example, eye divider 20 may be fabricated from a semi-rigid foam material such as rubber or polyurethane. Additionally or alternatively, the regions of eye divider 20 and pivoting coupling 30 that engage with each other may have a rough finish rather than a smooth finish or may have a high co-efficient of friction rather than being slippery. In yet another alternative, a material having a high static co-efficient of friction, such as a rubber or elastomer, may be provided between eye divider 20 and bearing surface 33 to generate the desired friction therebetween.

Figure 6:
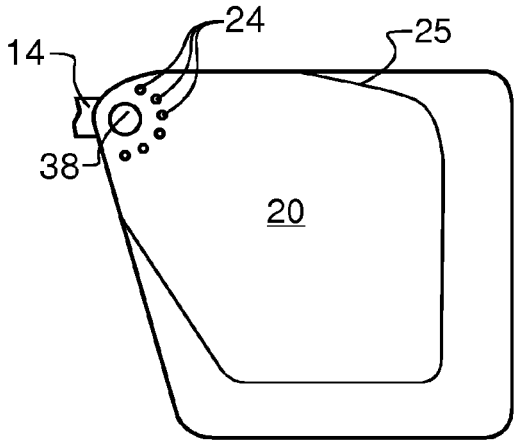
FIG. 6 illustrates the exemplary coupling between eye divider and frame used in the first preferred embodiment baseball training apparatus of FIG. 1, from an enlarged side elevation view.

Coupling 30, illustrated in detail in FIGS. 5 and 6, enables a person to remove eye divider 20 if so desired. This permits a player 1 to remove and replace eye divider 20 with a similar divider of different geometry. In accord with the methods of the invention, a player 1 may then select how far eye divider 20 extends from the player's nose 4, the slope relative to their nose 4, and other eye divider 20 dimensions or proportions by selecting one particular geometry eye divider 20 selected from a variety of eye dividers 20, each having different geometries. This selection may be made at any time, including immediately before or during a particular use or practice session.

Figure 3:
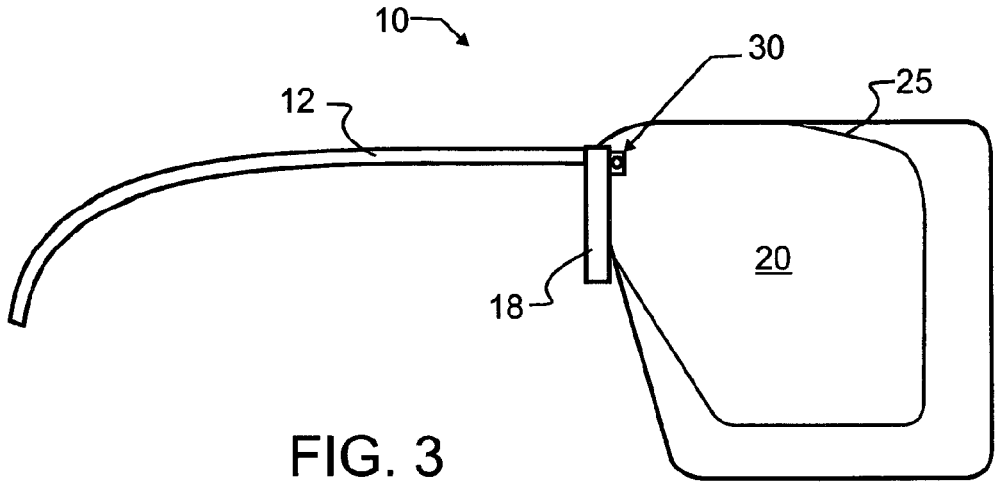
FIG. 3 illustrates the first preferred embodiment baseball training apparatus of FIG. 1 from a side elevation view, and having a preferred eye divider in a first position.
Figure 4:
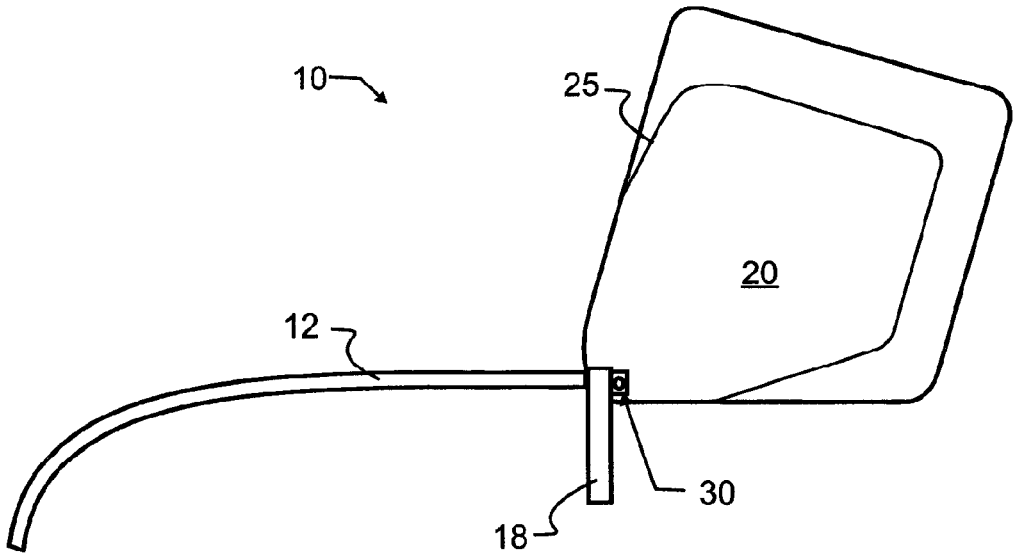
FIG. 4 illustrates the first preferred embodiment baseball training apparatus of FIG. 1 from a side elevation view, and having the preferred eye divider in a second position.

In an alternative embodiment, eye divider 20 may be provided with one or more scribes therein, such as scribe 25 illustrated in FIG. 3. The purpose of scribe 25 is to allow a player 1 to break off and dispose of the portion of eye divider 20 exterior to scribe 25, should player 1 desire a smaller or differently shaped eye divider. The number and placement of scribes 25 is essentially unlimited, and can be used to accommodate players of different sizes or preferences, or having noses 4 of different geometry, or for any other reason.

Figure 7:
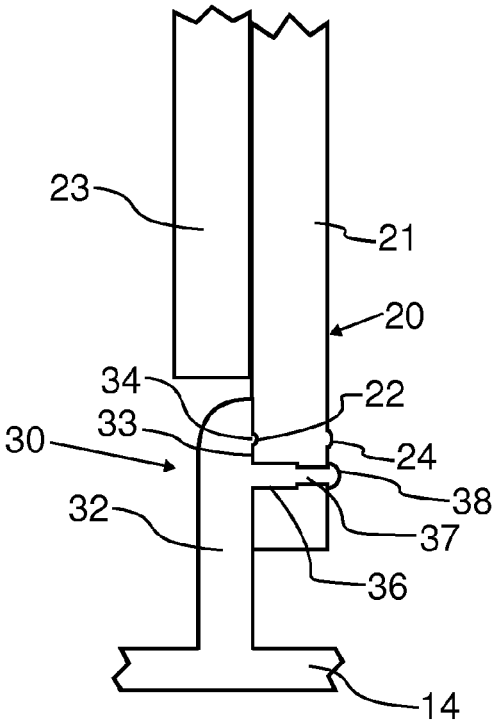
FIG. 7 illustrates an alternative eye divider from the sectional view of FIG. 5.

In yet another alternative, eye divider 20 may be intrinsically extendible, or may be provided on a support or mount that permits eye divider 20 to be moved generally parallel to the sagittal plane, such that eye divider 20 may be moved farther from or closer to eyes 2,3 and nose 4. The purpose of making eye divider 20 extendible is similar to the provision of scribes 25, permitting adjustment to be made by a player 1. However, unlike scribes 25, such adjustment, if designed accordingly, could be made at any time by player 1. For exemplary purposes, and not limited solely thereto, eye divider 20 may be made intrinsically extendible by fabricating eye divider 20 not from a single sheet of material, but from two or more layers 21, 23 as illustrated in FIG. 7. The layers may be held together with any suitable coupling technique including but not limited to hook and loop fasteners, tapes and adhesives, holes and protrusions similar to holes 16, or other fasteners. Layer 21 is coupled directly to coupling 30, while layer 23 is supported solely by and may be extended along layer 21, such that layer 23 may then be adjusted relative to layer 21 to extend farther from nose 4.

In a further alternative, eye divider 20 may take on dimensions other than the generally planar, sheet form such as illustrated in FIG. 2, and so may, for exemplary purposes only and not limiting thereto, take on the shape of a V when viewed from above as in FIG. 2, with the point of the V distal to eyes 2, 3 and nose 4, thereby essentially mimicking the shape of nose 4 from that top view but extending nose 4 by a desired amount.

Figure 8:
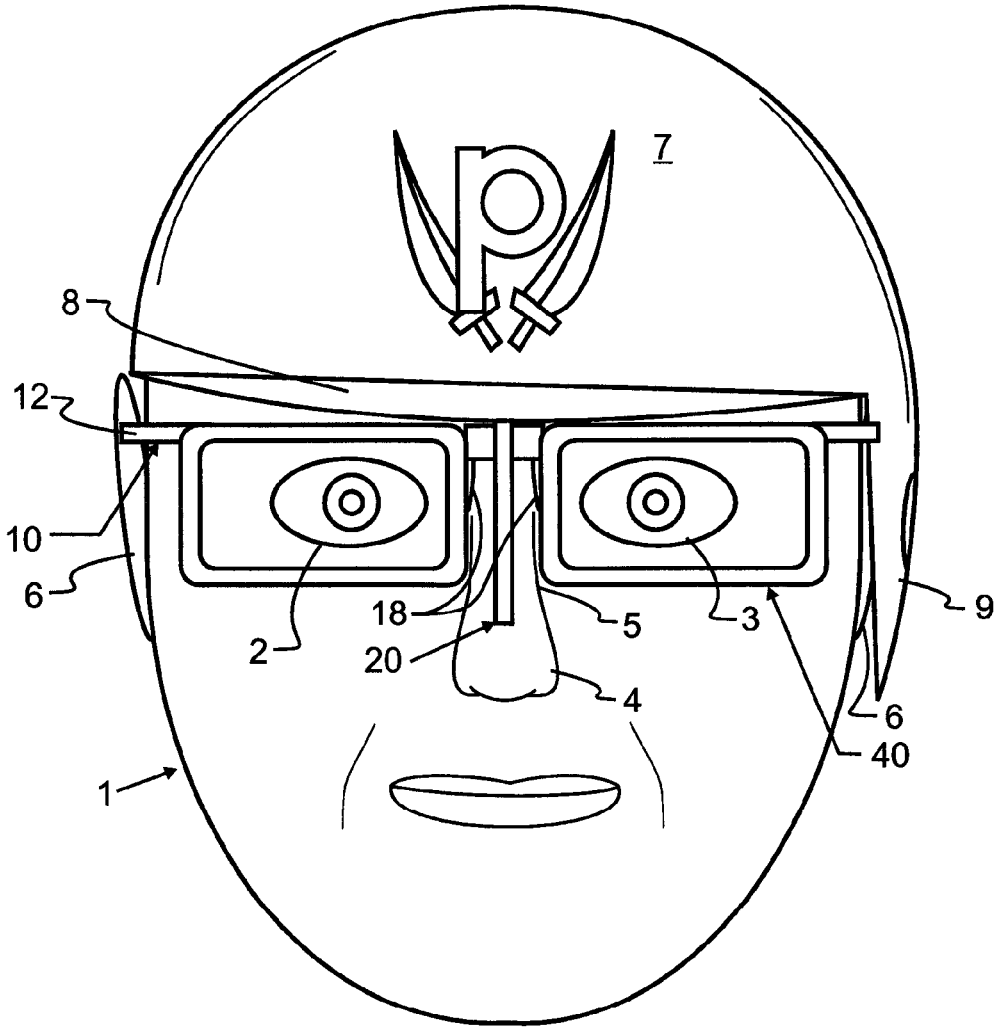
FIG. 8 illustrates a second preferred embodiment baseball training apparatus designed in accord with the teachings of the present invention.

FIG. 8 illustrates a second preferred embodiment baseball training apparatus 10, which otherwise resembles that of FIG. 1 but with the addition of eye frames 40. These frames may be fabricated integrally with top bar members 14, or may have protrusions suitable to be press fit into holes 16. Suitable protrusions provided on temples 12 and eye frames 40 might, for exemplary purposes only and not limiting thereto, comprise a shaft terminated by a slightly bulbous end, resembling a pin with a round pin head. The bulbous portion would preferably pass just through a hole 16, with the shaft remaining in the hole 16 and having a diameter similar thereto. Eye frames 40 may optionally be provided with clear, tinted, polarized, corrective, or otherwise treated eye pieces, as may be desired for beneficial function or aesthetic or ornamental appearance.

Most preferably, baseball training apparatus 10 will be fabricated from materials that are safe for the application. Preferred materials are semi-rigid such that they maintain shape during ordinary and intended use, but that, in the event of an impact from a ball or other object, the material will deform without harming the player. Exemplary materials include, but are not limited to, elastomers, rubber, foam, certain plastics, composites, and laminates. Reinforcing or shape maintaining materials may be provided to help maintain structural integrity or shape. Finally, the components will preferably be free of dangerous edges or significant protrusions that might harm a player, in the event the player were to be wearing baseball training apparatus 10 and be struck by a ball or other object.

While the foregoing details what is felt to be the preferred embodiment of the invention, no material limitations to the scope of the claimed invention are intended. Further, features and design alternatives that would be obvious to one of ordinary skill in the art are considered to be incorporated herein. For exemplary purpose, the preferred and alternative embodiments illustrated herein are mounted upon a frame similar to eyeglasses. However, the structure supporting the eye divider 20 is not critical to the invention, and might, for exemplary purposes, include a batting helmet, baseball cap, or other head covering or attachment. While the present invention is described with specific reference to baseball, for the purposes of the present disclosure baseball will be understood to include closely related sports such as softball that have a pitcher and hitter, where the hitter will orient their shoulders askance to the pitcher but must still properly view pitcher and pitch. The scope of the invention is set forth and particularly described in the claims herein below.

I claim:

1. A method of confirming visual alignment of a baseball player during batting so that both right and left eyes of said baseball player are facing in sight of a pitcher and baseball, comprising the steps of:

occluding peripheral vision within each of said right and left eyes to create two perceived images of said visual divide by the steps of extending a visual divide generally centered between said right and left eyes first defined by a nose on said player's face away from adjacent to said nose and generally parallel to a central sagittal plane of said baseball player to block sight of said pitcher and baseball that would otherwise cross adjacent to said player's nose; and retaining said visual divide extension in abutment with said nose and generally parallel to said central sagittal plane of said baseball player; and centering a perceived image of at least one of said pitcher and said baseball between said two perceived images of said visual divide extension.

2. The method of confirming visual alignment of a baseball player during batting of claim 1, further comprising the steps of:

pitching said baseball towards said batter; and maintaining said perceived image of said baseball centered between said two perceived images of said visual divide extension.

3. The method of confirming visual alignment of a baseball player during batting of claim 1, further comprising the steps of:

scribing said visual divide; and breaking off a portion of said visual divider exterior to said scribe to thereby decrease a size of said visual divider.

4. The method of confirming visual alignment of a baseball player during batting of claim 1, wherein said step of extending said visual divide further comprises extending said visual divide to substantially define a plane generally parallel to said central sagittal plane of said baseball player.

5. A method of confirming visual alignment of a baseball player during batting so that both right and left eyes of said baseball player are facing in sight of a pitcher and baseball, comprising the steps of:

occluding peripheral vision within each of said right and left eyes to create two perceived images of said visual divide by the steps of extending a visual divide generally centered between said right and left eyes first defined by a nose on said player's face away from said nose and generally within a central sagittal plane of said baseball player;

scribing said visual divide;

breaking off a portion of said visual divider exterior to said scribe to thereby decrease a size of said visual divider; and retaining said visual divide extension in abutment with said nose and generally within said central sagittal plane of said baseball player; and centering a perceived image of at least one of said pitcher and said baseball between said two perceived images of said visual divide extension.

* * * * *